United States Patent [19]

Calliebe

[11] Patent Number: 4,813,169

[45] Date of Patent: Mar. 21, 1989

[54] BULLET SETTING DEVICE

[76] Inventor: Dietrich Calliebe, Reichsstrasse 45, D-1000 Berlin 19, Fed. Rep. of Germany

[21] Appl. No.: 166,241

[22] Filed: Mar. 9, 1988

[30] Foreign Application Priority Data

Mar. 9, 1987 [DE] Fed. Rep. of Germany ... 8703660[U]

[51] Int. Cl.[4] ..... F41C 27/00

[52] U.S. Cl. ..... 42/90

[58] Field of Search ..... 42/90, 95

[56] References Cited

U.S. PATENT DOCUMENTS

| | | | |
|---|---|---|---|
| 3,286,293 | 11/1966 | Eckert | 42/95 |
| 3,747,252 | 7/1973 | Walker | 42/90 |
| 4,050,175 | 9/1977 | Mulinix | 42/90 |
| 4,152,858 | 5/1979 | Dobbs | 42/90 |
| 4,327,515 | 5/1982 | Kuryn | 42/90 |
| 4,407,086 | 10/1983 | Hasselmann | 42/90 |
| 4,434,571 | 3/1984 | Eisenhuth | 42/90 |
| 4,442,619 | 4/1984 | McCarley | 42/90 |
| 4,466,209 | 8/1984 | Strickland et al. | 42/90 |
| 4,473,965 | 10/1984 | Erikson | 42/90 |

*Primary Examiner*—Charles T. Jordan
*Attorney, Agent, or Firm*—Spencer & Frank

[57] ABSTRACT

A bullet setting device for setting a bullet in a muzzle of a gun includes a rod having a guide rod portion and a driving rod portion. The guide rod portion and the driving rod portion have a first end which is common to both rod portions and the rod further has respective opposite second and third ends. A driving anvil is disposed at the first end, a setting anvil is disposed at the second end and a striking member is slidably disposed on the rod and being movable between the setting anvil and the driving anvil for selectively impacting the one or the other anvil. An initial bullet setting device is mounted on the rod at the second end for introducing the bullet into the muzzle upon striking the setting anvil with the striking member. Further, a handle is disposed adjacent the setting anvil; and a projection is provided on the rod at the third end for receiving a bullet handling device for engaging the bullet situated in the barrel, upon striking the driving anvil with the striking member.

20 Claims, 2 Drawing Sheets

BULLET SETTING DEVICE

BACKGROUND OF THE INVENTION

1. Field of the Invention

The present invention relates to a bullet setting device used by competitive marksmen who use muzzle loaders with black powder.

2. Description of the Prior Art

It is known to strike a loading hammer with one blow in order to drive a bullet sitting on a patch into the rifling of a muzzle loader. The bullet which is used for this procedure can have a round or ogival shape. Next, the bullet must be driven at least 1–2 cm deep into the gun barrel by means of a bullet setting rod having a length of 1–3 cm. The bullet setting rod may be fastened to this hammer itself or to a wooden ball. Then, the palm of the user's hand hits hard on the hammer or the wooden ball to drive the bullet at least 1–2 cm deep into the barrel. Thereafter, the subcaliber hammer handle or the extended setting rod on the wooden ball is used to drive the bullet at least about 10 cm further into the gun barrel by additional strikes with the user's palm or with the hammer. Finally, a ramrod is inserted into the gun barrel to set the bullet by pushing the bullet down to the charge. Since only bullets tightly seated in the barrel produce good hit patterns, a great amount of force must be expended to obtain tightly seated bullets. As a result, contusions and injuries sometimes occur. Tightly seating each bullet is the most difficult and time consuming process during loading.

SUMMARY OF THE INVENTION

It is an object of the present invention to provide a bullet setting device which simplifies, facilitates and shortens the time required for the difficult process of setting tightly guided patch bullets.

The above and other objects are accomplished by the invention in which a bullet setting device for setting a bullet in a muzzle of a gun comprises a rod having a guide rod portion and a driving rod portion, the driving rod portion including a projection at one end of the rod; a driving anvil disposed on the rod and separating the guide rod and driving rod portions from one another; a setting anvil disposed on the rod at the other end of the guide rod portion; a striking member slidably disposed on the rod and movable between the setting anvil and the driving anvil; and a handle adjacent the setting anvil.

The impacts required for driving bullets into muzzle-loader barrels in the selected striking direction during the setting, loading or bullet extraction processes are favorably effected by the striking member of the device.

It is of particular advantage that the user can invert the device until the respectively required anvil (either the setting anvil or the driving anvil) is between the location of the striking member and the muzzle-loader barrel. This places the required anvil in a position where it can be utilized without further manipulation.

A hardwood part disposed on the setting anvil has at its planar upper (outer) surface a centrally disposed circular concave recess. Setting members having diameters to accommodate different bullet calibers are exchangeably fastenable to the end of the guide rod portion.

When using muzzle loading pistols, the short setting member can be replaced by an extended setting rod which has a length corresponding to the length of the entire barrel and is adapted in diameter to the bullet caliber. This setting rod can be fastened to the driving rod portion to serve as the ramrod. The bottom of the setting rod can be unscrewed and replaced with cleaning brushes, wiping rag holders or bullet extractors.

An adapter sleeve is also connectable with the projection on the driving rod portion. The adapter is provided with two internal threads, one at each end. One thread is connectable to the projection on the driving rod portion and the other thread is connectable to one end of a ramrod. The ramrod is usually an accessory for the weapon and is even longer than the setting rod.

The striking member includes a bore therethrough which has a diameter at the ends of the bore which is larger than the diameter of the remainder of the bore. Due to this arrangement the small material deformations which occur when the striking member hits the respective anvil will not interfere with the free sliding of the striking member on the guide rod portion.

DESCRIPTION OF THE PREFERRED EMBODIMENTS

Figure 1:
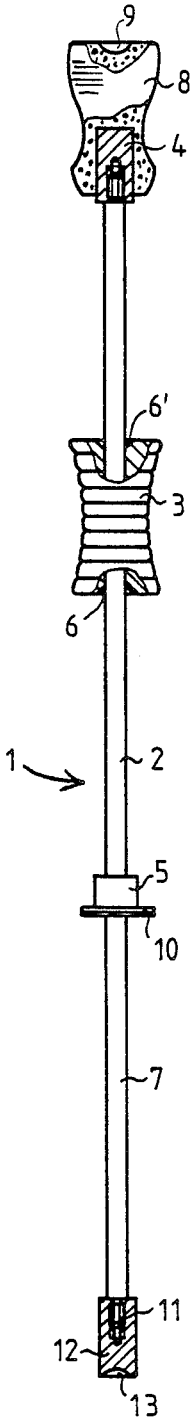
FIG. 1 is a longitudinal side view, partially in section, of a preferred embodiment of the device according to the invention.

FIG. 1 shows a preferred embodiment of a bullet setting device generally indicated by reference numeral 1. Bullet setting device 1 is composed of a round steel rod having an overall length of about 360 mm and a diameter of about 7 mm. The rod is divided into two portions, a guide rod portion 2 and a driving rod portion 7. Guide rod portion 2 has a length of approximately 220 mm and driving rod portion 7 has a length of approximately 125 mm. A generally cylindrical striking member 3 is displaceably provided on guide rod portion 2. Striking member 3 is composed of a piece of round steel having a length of about 50 mm, a diameter of about 30 mm and a mass of about 250 grams. Striking member 3 can easily slide up and down on the guide rod portion 2.

The path of striking member 3 is delimited by two thickened portions which have abutment faces and form a setting anvil 4 and a driving anvil 5. Setting anvil 4 is screwed onto one end of the rod while driving anvil 5 is fixed to the rod adjacent the common end of the guide rod portion 2 and the driving rod portion 7. The driving anvil 5 has a length of about 10 mm and a diameter of about 14 mm. The setting anvil 4 has a length of about 25 mm and a diameter of about 12 mm.

Striking member 3 can easily be moved by the user's thumb and index finger so that the striking member 3 can forcibly strike the setting anvil 4 as well as the driving anvil 5. By this movement the mass of striking member 3 acts as a hammer against the respective anvil.

The striking member 3 is a member having a basically cylindrical configuration. However, for better manipulation striking member 3 can be tapered toward the center and provided with transverse grooves to enhance gripping.

Striking member 3 includes a bore therethrough whose opposite ends slightly widen at 6 and 6' so that slight material deformations which occur during striking do not adversely influence the free sliding of the striking member 3 on the guide rod portion 2. The widened portions 6 and 6' each border on the planar surfaces of the striking member 3.

Both ends of the steel rod (composed length portions 2 and 7) are provided with an external thread which cooperates with an internal thread of the setting anvil 4 to hold the latter at the end of the guide rod portion 2. Setting anvil 4 is inserted into a handle 8 which is fastened thereto.

In the center of the planar surface of the handle 8 located on its upper side is a circular concave recess 9. Recess 9 serves as a centering aid for the first strike on the bullet.

Handle 8 is of wood or a plastic material. A nonillustrated alternative to the handle 8 fastened to setting anvil 4, the handle 8 may contain a self-cutting threaded sleeve which is screwed in a force-locking manner to the guide rod portion 2. An abutment surface for the striking member 3 may be formed at one end of the handle 8, by covering the sleeve opening or placing a washer therebetween. This abutment surface will correspond in position to the position of the annular frontal face of setting anvil 4.

A washer 10 is attached to the driving anvil 5 adjacent its surface facing the driving rod portion 7. The washer 10 has a diameter of about 24 mm and serves to limit the extent to which driving rod portion 7 is inserted into the gun muzzle by the driving process. To the washer 10 there is glued a leather disc which protects the gun muzzle. The leather disc is attached to the flat surface of washer 10 facing toward the driving rod portion 7.

At the end of driving rod portion 7 there is a projection 11 which has an external surface provided with a thread to receive a bullet setting member 12 made of brass. At the impact end of bullet setting member 12 is a concave portion 13 which is adapted to the shape of the bullet to be set.

The exchangeable setting members 12 have diameters of 7.5 mm, 10 mm or 14 mm, so that any of the respective bullet calibers of the muzzle loaders may use the bullet setting device 1 according to the invention. Since setting member 12 has different uses such as for a setting path of about 120 mm and as a ramrod for setting the bullet down at the bottom of the piston barrel, setting members may have lengths from about 25 mm to about 125 mm.

Figure 2:
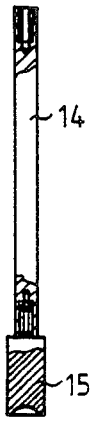
FIG. 2 is a longitudinal side view, partially in section, of a setting rod forming part of a preferred embodiment.

Setting member 12 may be exchanged for a setting rod 14 shown in FIG. 2. Setting rod 14 has a length of 135 mm and has an exchangeable bottom member 15 disposed at its end. The exchangeable setting rod 14 is preferably made of brass with the bottom member 15 being made of plastic or wood.

Setting rod 14 and bottom member 15 are designed to have a length that allows all customary muzzle loader pistols to be loaded without the ramrod provided for that purpose.

Figure 3:
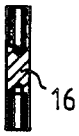
FIG. 3 is a longitudinal sectional view of an adapter forming part of a preferred embodiment.

FIG. 3 shows an adapter 16 that allows a ramrod to be attached to the bullet setting device. Adapter 16 has a cylindrical configuration with one bore disposed in each end thereof. Each bore is provided with an internal thread for allowing the adapter 16 to threadedly engage both the projection 11 and the ram rod.

Figure 4A:
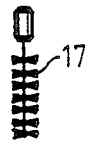
FIG. 4*a* is a side view of a cleaning brush forming part of a preferred embodiment.
Figure 4B:
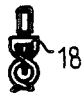
FIG. 4*b* is a side view of a bullet extractor forming part of a preferred embodiment.

FIG. 4*a* illustrates a cleaning brush 17 and FIG. 4*b* illustrates a bullet extractor 18. Both the cleaning brush 17 and the bullet extractor 18 have a corresponding thread at one end with which they can be selectively inserted into the end of setting rod 14 instead of bottom member 15.

The operation of the bullet setting device will now be described with reference to FIGS. 5*a* to 5*d*.

Figure 5D:
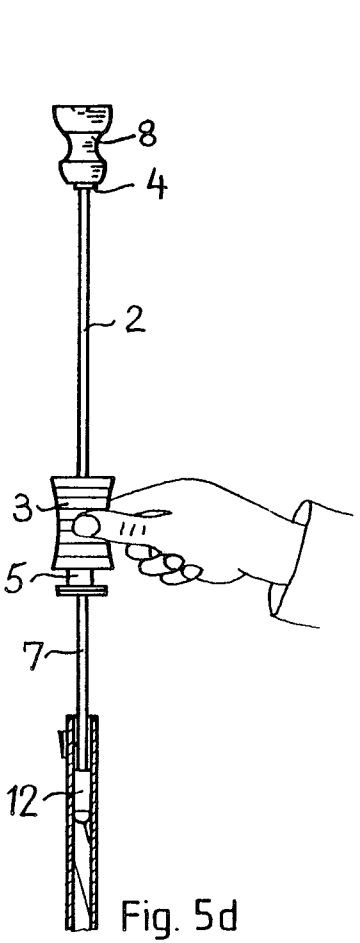
FIGS. 5*a* to 5*d* are longitudinal side views of the preferred embodiment, illustrated in various stages of operation.
Figure 5C:
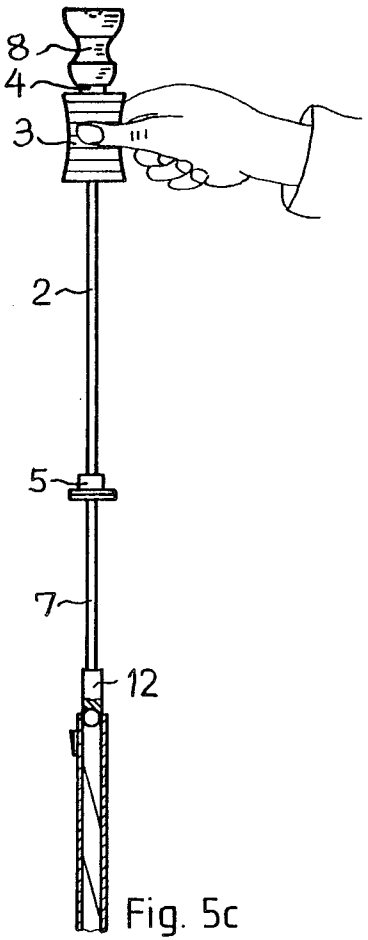
Figure 5B:
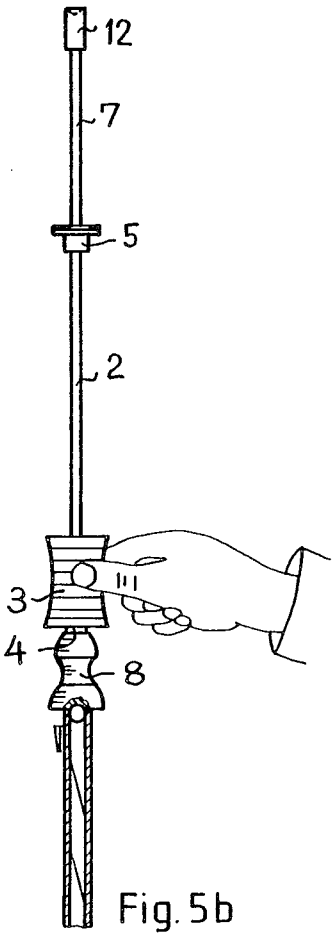
Figure 5A:
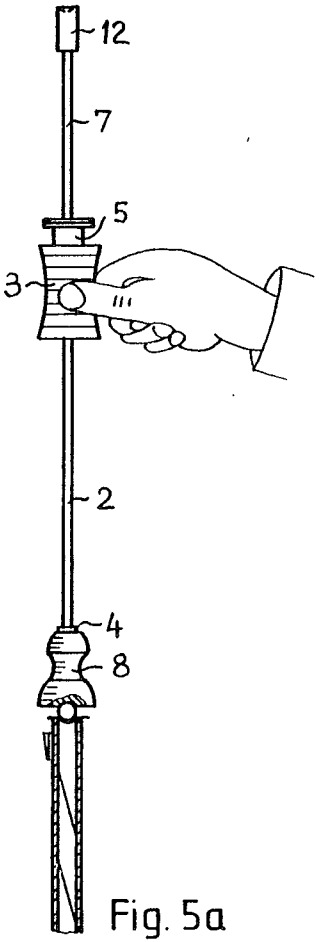

Bullet setting member 1 is gripped at striking member 3 by the user's thumb and index finger. Bullet setting member 1 is then positioned so that gravity causes setting anvil 4 to slide down and come to rest lightly on the bullet to be loaded. Since the bullet is still projecting from the muzzle this helps to center the setting anvil because the bullet protrudes into the central concave portion 9 of the handle 8. In this position, the striking member 3 is below and adjacent to driving anvil 5 with the bullet setting device 1 being in an approximately vertical position (FIG. 5*a*). Then a slight tap with the striking member 3 drives the bullet easily into the rifling of the muzzle loader (FIG. 5*b*). Without having to release hold of the striking member 3, the striking member 3 is raised until it abuts at the driving anvil 5 thereby lifting the device. Then the bullet setting device 1 is turned about 180°, about an axis transverse to the rod. Following this rotation, driving rod portion 7 points down and slides toward the muzzle due to gravity (FIG. 5*c*). Since the striking member 3 is now adjacent the setting anvil 4, the striking member can perform short downward strokes against driving anvil 5. After each stroke the driving anvil 5 moves toward the muzzle until, after two to three strokes, the leather disc contacts the muzzle, terminating this process.

In this state, the bullet is in the barrel to a depth of about 120 mm. The bullet is thus in a pressed-in state and can easily be brought onto the charge in the traditional manner by driving the bullet with the ramrod of the muzzle loader.

The entire process takes only a few seconds and is accomplished with great ease and without any major expenditure of force on the part of the user.

When loading pistols, the setting rod 14 (FIG. 2) which has a length corresponding to the length of the barrel 12 is screwed to the projection 11 of the driving rod portion 7, replacing the bullet setting member 12. With a bullet setting depth of 120 mm, the limiting member 10 of the driving anvil 5 has not yet seated on the end of the muzzle. In this position, the striking member 3 can be released because the driving rod portion 7 or the setting rod 14 is positioned in the barrel and holds the bullet setting device 1. Now the free hand can be placed on the handle 8 and a downward pressure applied to the device 1 to bring the bullet onto the charge. By use of this procedure, a separate ramrod is no longer required.

The invention may find advantageous use when a bullet is to be extracted from the barrel. Various circumstances arise that make it necessary to extract the bullet and its patch from the barrel after they have been loaded to the bottom of the barrel. One such circumstance is where the powder was not previously loaded. The prior art method of bullet extraction was to use the ramrod which had a bullet extractor screwed to the end. The ramrod wash pushed down to the bullet and then rotated so that the corkscrew helixes and screw thread gripped the bullet. Because the ramrod only projected slightly from the muzzle it was generally complicated and difficult to pull the ramrod and the wedged-in bullet from the muzzle. According to the present invention, the adapter 16 is screwed onto projection 11 and the ramrod of the gun is screwed into the adapter 16. The ramrod containing the bullet extractor 18 is now inserted into the muzzle and the bullet extractor 18 is attached to the bullet. The striking member 3 may now be forced upwardly against setting anvil 4 thereby dislodging the bullet from the wedged-in condition. Once the bullet is released from the wedged-in condition, the bullet can be removed from the barrel by pulling up on the handle 8.

Another advantage of the present invention is that the setting, loading and extracting of bullets in muzzle-loaders regardless of the caliber or the length of the barrel, is possible with the same bullet setting device, thereby making the device very versatile.

The bullet setting device 1 according to the present invention permits manipulations which are also suitable for precision firearms. For precision firearms, the precision barrels are treated very gently, so as to produce the identical conditions for all successive shots thereby limiting the unavoidable "spread" to a minimum. To accomplish a minimum "spread", the following measures are utilized in addition to those discussed earlier: commercially available muzzle protectors made of plastic or another suitable shock-absorbing material are used to enclose the rod and these are placed on the driving rod portion 7 or on the setting rod 14 to avoid any contact with the muzzle itself.

Markings or delimiting sleeves may be provided on the driving rod portion 7 or the setting rod 14 to assist in preventing the device from penetrating too deeply into the barrel.

Additional protection of the barrel is realized if the brass setting members (which are designed for the respective barrel caliber of the weapon) are given a length so that their placement against the inner barrel bore prevents canting of the setting member 12 or bottom member 15 on the first few centimeters of the loading path. This means that the driving rod portion 7 or setting rod 14 are unable to touch the inner muzzle edge of the barrel because the muzzle protector, which has a length of about 3 cm, is able to slide down or is pushed by the user until it engages the muzzle. This movement of the muzzle protector protects the muzzle edge from contacting the driving anvil 5.

Additionally, the driving rod portion 7 and/or the setting rod 14 is preferably provided with a jacket which is also composed of plastic or the like.

It will be understood that the above description of the present invention is susceptible to various modifications, changes and adaptations, and the same are intended to be comprehended within the meaning and range of equivalents of the appended claims.

What is claimed is:

1. A bullet setting device for setting a bullet in a muzzle of a gun, comprising:

a rod having a guide rod portion and a driving rod portion; said guide rod portion and said driving rod portion having a first end common to said guide rod portion and said driving rod portion and respective opposite second and third ends;

a driving anvil disposed at said first end;

a setting anvil disposed at said second end;

a striking member slidably disposed on said rod and movable between said setting anvil and said driving anvil for selectively impacting said driving anvil or said setting anvil;

initial bullet setting means mounted on said rod at said second end for introducing the bullet into the muzzle upon striking said setting anvil with said striking member;

a handle disposed adjacent said setting anvil; and a projection on said rod at said third end for receiving bullet handling means for engaging the bullet situated in the barrel, upon striking said driving anvil with said striking member.

2. A bullet setting device as defined in claim 1, wherein said projection has an outer surface containing an external thread.

3. A bullet setting device as defined in claim 1, wherein said handle has a planar surface disposed at said second end, said planar surface being oriented generally perpendicularly to a length dimension of said rod and containing a centrally disposed circular concave recess; said handle comprising said initial bullet setting means.

4. A bullet setting device as defined in claim 1, wherein said handle is composed of wood.

5. A bullet setting device as defined in claim 1, wherein said handle is composed of a plastic material.

6. A bullet setting device as defined in claim 1, wherein said bullet handling means comprises a setting member connected to said projection and extending from said third end of said rod.

7. A bullet setting device as defined in claim 6, wherein said setting member is releasably connected to said projection.

8. A bullet setting device as defined in claim 1, wherein said bullet setting means comprises a setting rod connected to said projection and extending from said third end of said rod.

9. A bullet setting device as defined in claim 8, further comprising:

a bottom member having a threaded attachment means, said bottom member being connected to said setting rod through said threaded attachment means.

10. A bullet setting device as defined in claim 8, further comprising:

a cleaning brush having threaded attachment means, said cleaning brush being connected to said setting rod through said threaded attachment means.

11. A bullet setting device as defined in claim 8, further comprising:

a wiping rag holder having threaded attachment means, said wiping rag holder being connected to said setting rod through said threaded attachment means.

12. A bullet setting device as defined in claim 8, further comprising:

a bullet extractor having threaded attachment means, said bullet extractor being connected to said setting rod through said threaded attachment means.

13. A bullet setting device as defined in claim 8, wherein said setting rod is releasably connected to said projection.

14. A bullet setting device as defined in claim 1, further comprising:

an adapter connected to said projection and extending from said third end of said rod, said adapter including means defining an internally threaded bore at opposite ends of said adapter.

15. A bullet setting device as defined in claim 14, further comprising:

a ramrod having threaded attachment means, said ramrod being connected to said adapter through said threaded attachment means.

16. A bullet setting device as defined in claim 15, wherein said ramrod is releasably connected to said adapter.

17. A bullet setting device as defined in claim 1 wherein said striking member includes means defining a bore therethrough, said bore having two ends; at least one of said ends having a diameter greater than the diameter of the remainder of said bore.

18. A bullet setting device as defined in claim 1, further comprising a protection means for protecting various structural components of said device which may contact the muzzle of the gun.

19. A bullet setting device as defined in claim 1, further comprising a loading depth indicating means for indicating the loading depth of the bullet in the muzzle of the gun, said loading depth indicating means being providing on said driving rod portion of said rod.

20. A bullet setting device as defined in claim 8, further comprising a loading depth indicating means for indicating the loading depth of the bullet in the muzzle of the gun, said loading depth indicating means being provided on said setting rod.

* * * * *